US012685925B2

(12) United States Patent
Girtman et al.

(10) Patent No.: US 12,685,925 B2
(45) Date of Patent: Jul. 21, 2026

(54) GAME TARGET, ENTERTAINMENT SYSTEM, AND METHOD OF USE

(71) Applicants: Michael L. Girtman, Imperial, MO (US); Trenda J. Girtman, Imperial, MO (US)

(72) Inventors: Michael L. Girtman, Imperial, MO (US); Trenda J. Girtman, Imperial, MO (US)

( * ) Notice: Subject to any disclaimer, the term of this patent is extended or adjusted under 35 U.S.C. 154(b) by 503 days.

(21) Appl. No.: 18/211,384

(22) Filed: Jun. 19, 2023

(65) Prior Publication Data

US 2024/0416218 A1 Dec. 19, 2024

(51) Int. Cl.
*A63F 9/02* (2006.01)
*A63F 9/04* (2006.01)

(52) U.S. Cl.
CPC ..... *A63F 9/0204* (2013.01); *A63F 9/0415* (2013.01); *A63F 2009/0446* (2013.01)

(58) Field of Classification Search
CPC .... A63F 9/0204; A63F 9/0402; A63F 9/0406; A63F 9/0415; A63F 9/0495; A63F 3/00003; A63F 5/04; A63F 5/041
USPC ..... 273/236, 287
See application file for complete search history.

(56) References Cited

U.S. PATENT DOCUMENTS

| | | | | |
|---|---|---|---|---|
| 701,484 | A | 6/1902 | Johnson | |
| 970,901 | A | 9/1910 | Ernst | |
| 991,523 | A | 5/1911 | McClay | |
| 1,242,198 | A | 10/1917 | Jones | |
| 1,554,768 | A | 9/1925 | Stoddart | |
| 1,623,284 | A | 4/1927 | Stoddart | |
| 1,656,740 | A | 1/1928 | Kurtz | |
| 1,692,519 | A | 11/1928 | Spilling | |
| 4,239,221 | A | 12/1980 | Griffin | |
| 4,299,392 | A | 11/1981 | Tammen | |
| 4,346,900 | A | 8/1982 | Lamlee | |
| 4,944,512 | A * | 7/1990 | Mauck | A63F 9/30 273/447 |
| 5,011,160 | A * | 4/1991 | Lacza | A63F 3/00006 273/282.1 |
| 5,863,045 | A | 1/1999 | Watson et al. | |
| 6,161,833 | A | 12/2000 | Gomez | |
| 7,287,755 | B1 | 10/2007 | Kershner | |
| 7,510,189 | B2 | 3/2009 | Carlson et al. | |
| 10,675,522 | B2 | 6/2020 | Galian et al. | |
| 10,792,558 | B1 * | 10/2020 | Goldstein | A63F 7/28 |
| 10,974,114 | B2 | 4/2021 | Kwiatek | |
| 2016/0332067 | A9 | 11/2016 | Knopf | |
| 2022/0047937 | A1 | 2/2022 | Brown | |

* cited by examiner

*Primary Examiner* — Thomas M Sember
(74) *Attorney, Agent, or Firm* — Fast Forward Law, LLC; David E. Crawford; Brian P. Klein

(57) ABSTRACT

A game device including a target platform having a delineated scoring area. The game device includes a post extending upward from the target platform and a cup mounted on the post opposite the target platform. The cup has a hollow interior sized and shaped for receiving a plurality of game pieces and an opening configured to pass each game piece through when positioning the game piece in the hollow interior and removing the game piece from the hollow interior.

20 Claims, 11 Drawing Sheets

GAME TARGET, ENTERTAINMENT SYSTEM, AND METHOD OF USE

BACKGROUND

The present disclosure is directed to an entertainment system, including a target and game pieces, and more particularly to a system including a target having integrated game piece storage and providing an opportunity for play as a game of skill, a game of chance, and a game combining both skill and chance.

Many tossing or throwing games have a target including one or more scoring areas. Players take turns tossing or throwing game pieces toward the scoring area. In general, players whose pieces come to rest in the scoring area are awarded points, and those with the most points win. Quarters, a tabletop game in which players attempt to bounce a coin into a cup, is an example of a single target tossing game. Although some target games only score when a piece comes to rest on a specific scoring area, many target games incorporate a bullseye target having a central scoring area surrounded by concentric annular scoring areas. Bullseye targets allow for graduated scoring by awarding a predetermined number of points for pieces resting in the central scoring area and progressively fewer points for pieces positioned in annular scoring areas farther from the center. Because bullseye targets provide scoring opportunities outside the central scoring area, they improve the chances of a less accurate player scoring compared to a target having one scoring area equal in size to the central scoring area of the bullseye target. Darts is an example of a bullseye target throwing game. Target throwing games are classified as games of skill because their outcome is dependent on physical ability rather than chance.

Although games of skill are appealing to many people, games of chance have random outcomes that even the odds of success for less skilled players. Craps is an example of a tossing game of chance in which two 6-sided dice are rolled and players wager on what dice combination they hope the dice will show after each roll. Pure games of chance require no physical skill or strategy to win. Each player has an equal chance of winning.

Many players enjoy games of skill and games of chance, and game systems that allow for play as a game of skill, a game of chance, or a game having elements of both offer versatility that broadens their appeal. In addition, some people enjoy wagering on games. Games that optionally allow for play with or without wagering also have a broader appeal. Further, game systems that allow both individual and team competition provide versatility that broadens their appeal. Some games such as table shuffleboard allow players to improve their scores and reduce their opponent's scores by displacing previously played pieces. These games introduce strategic elements such as positioning pieces to block anticipated moves by opponents based on order of play. These strategic elements provide additional sources of player enjoyment.

Although a variety of game systems exist that allow various combinations of the skill, chance, wagering, and strategy, as well as differing numbers of players, a need for new game systems exists to provide players novel variations and varieties of entertainment.

SUMMARY

In one aspect, the present disclosure includes a game device comprising a target platform having a delineated scoring area. The game device also includes a post extending upward from the target platform and a cup mounted on the post opposite the target platform. The cup has a hollow interior sized and shaped for receiving a plurality of game pieces and an opening configured to pass each game piece through when positioning the game piece in the hollow interior and removing the game piece from the hollow interior.

In another aspect, the present disclosure includes a tabletop game device comprising a target platform having a plurality of concentrically arranged circular scoring areas. Each of the scoring areas is separately defined by a corresponding ridge projecting upward from the target platform. The game device also includes a cylindrical post extending upward from the target platform at a center of the concentrically arranged circular scoring areas. Further, the game device comprises a receptacle mounted on the post opposite the target platform for receiving a plurality of regular-polyhedron-shaped game pieces.

Other aspects of the present disclosure will be apparent in view of the following description and claims.

BRIEF DESCRIPTION OF DRAWINGS

The present disclosure includes non-limiting examples illustrated in the accompanying drawings.

Corresponding reference characters indicate corresponding parts throughout the drawings.

DETAILED DESCRIPTION

Figure 1:
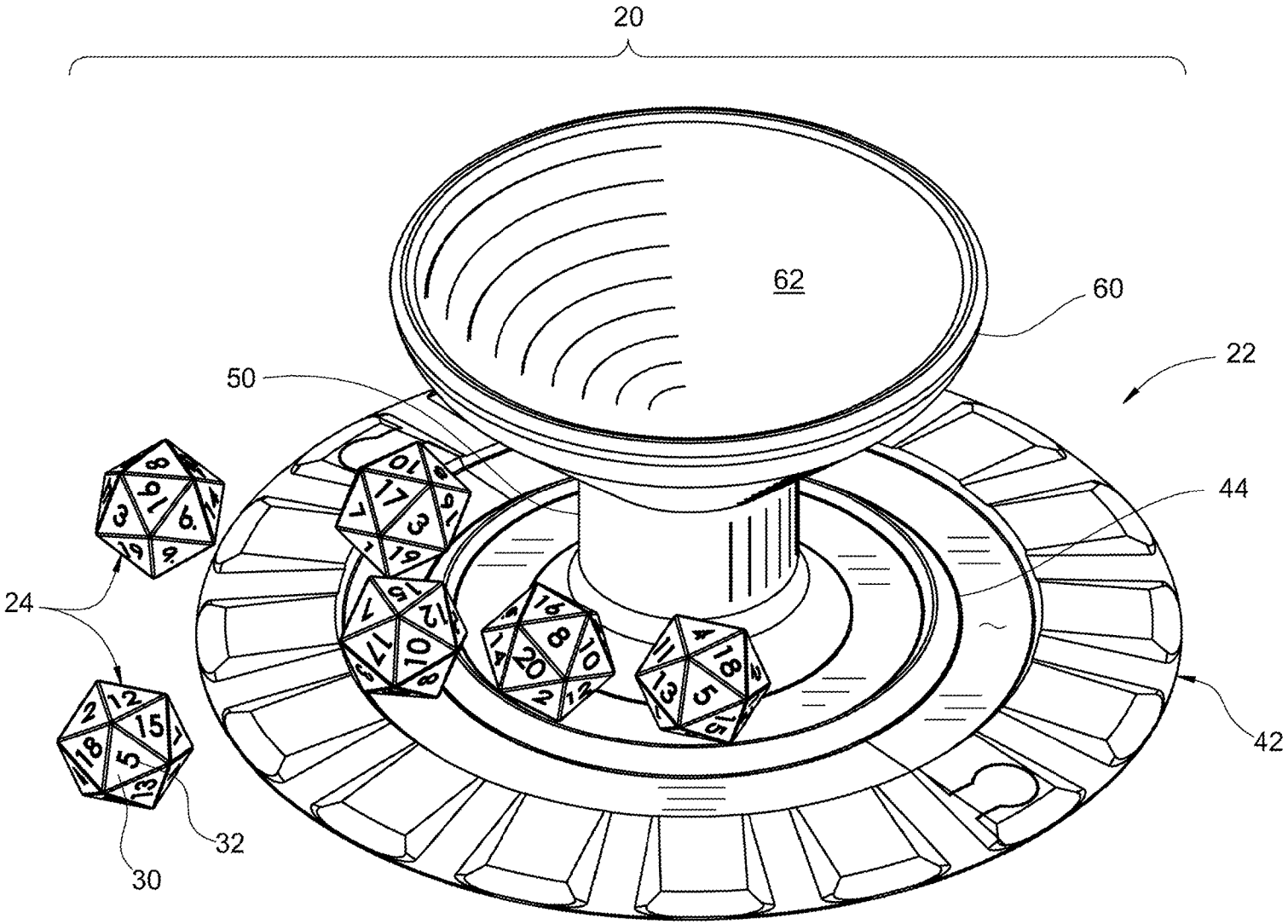
FIG. 1 is a perspective of a first example of a game system of the present disclosure.

FIG. 1 illustrates a first example of a game system designated in its entirety by the reference number 20. The illustrated game system 20 comprises a game target (broadly, a game device), generally designated by 22, and a plurality of game pieces, each of which is generally designated by 24. The game pieces 24 of the illustrated example are regular-icosahedron-shaped objects, e.g., conventional 20-sided dice. Those familiar with the art of game design will appreciate that the game pieces may have other shapes, including regular and irregular polyhedron shapes having planar faces 30. Although the illustrated game pieces have an equal number of faces, the number of faces may differ between game pieces. Further, although the illustrated game system 20 consists of six game pieces 24, it is envisioned the system may have other numbers of game pieces. Each of the faces 30 of the illustrated game pieces 24 has an Arabic numeral demarcation or symbol 32, however other types of demarcations (e.g., pips or non-numeric icons) are envisioned. Likewise, the demarcations 32 on each face 30 of the illustrated dice are unique with respect to the individual die, but repeated demarcations or faces without demarcations are also envisioned.

Figure 2:
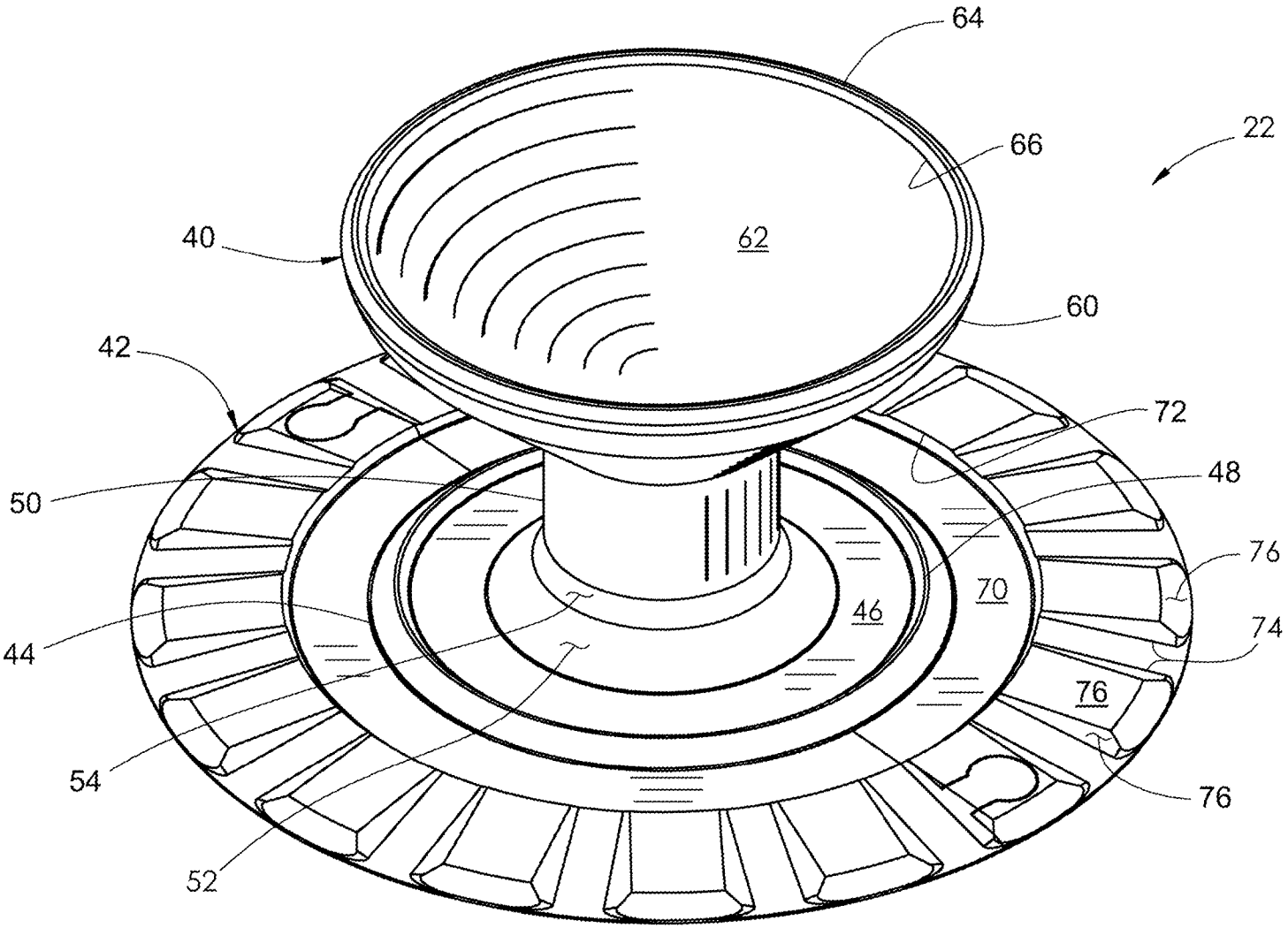
FIG. 2 is a perspective of a game device of the game system shown in FIG. 1.
Figure 3:
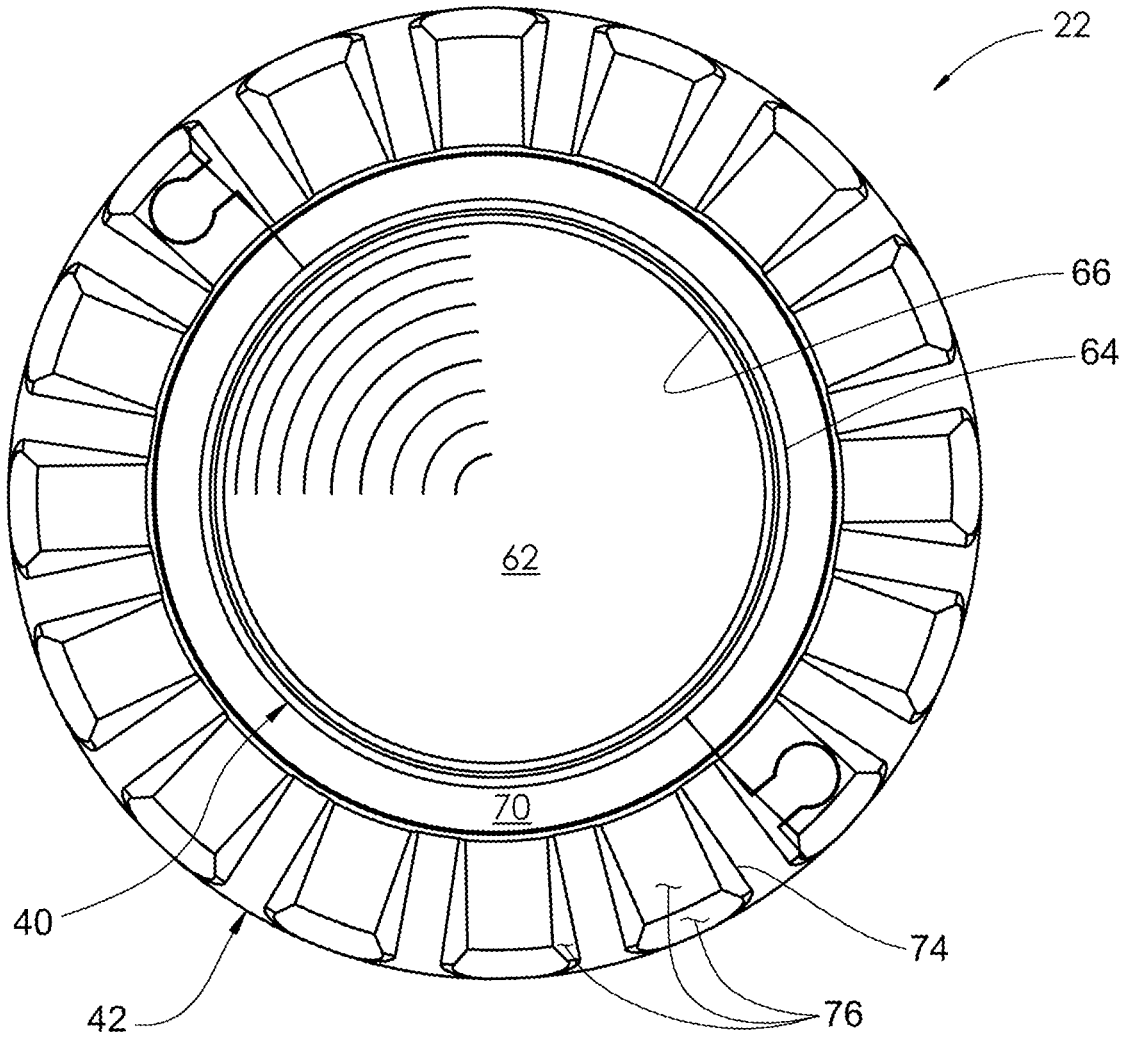
FIG. 3 is a top plan of the game device shown in FIG. 2.
Figure 4:
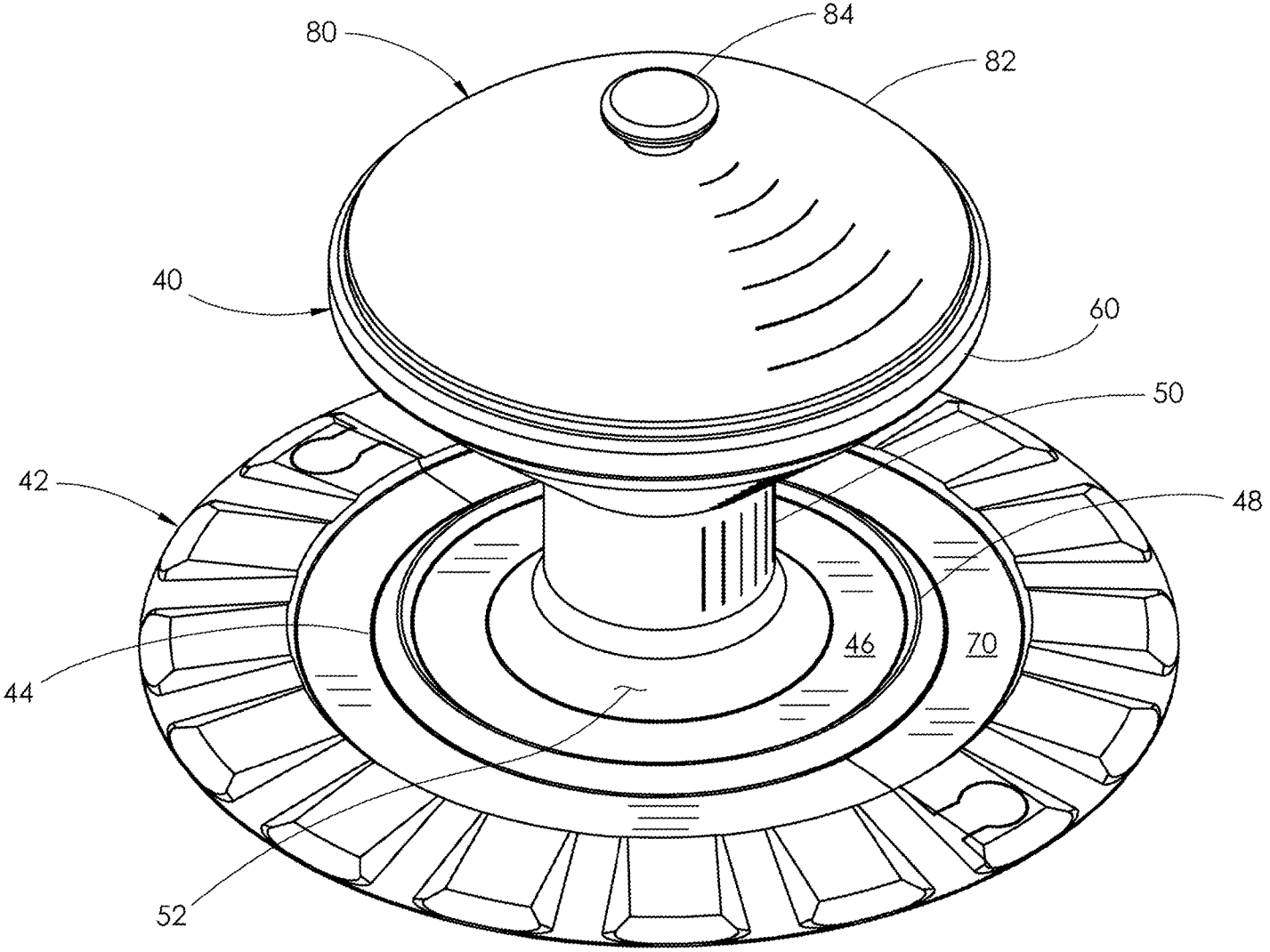
FIG. 4 is a perspective of the game device of FIG. 2 having a first exemplary lid
Figure 5:
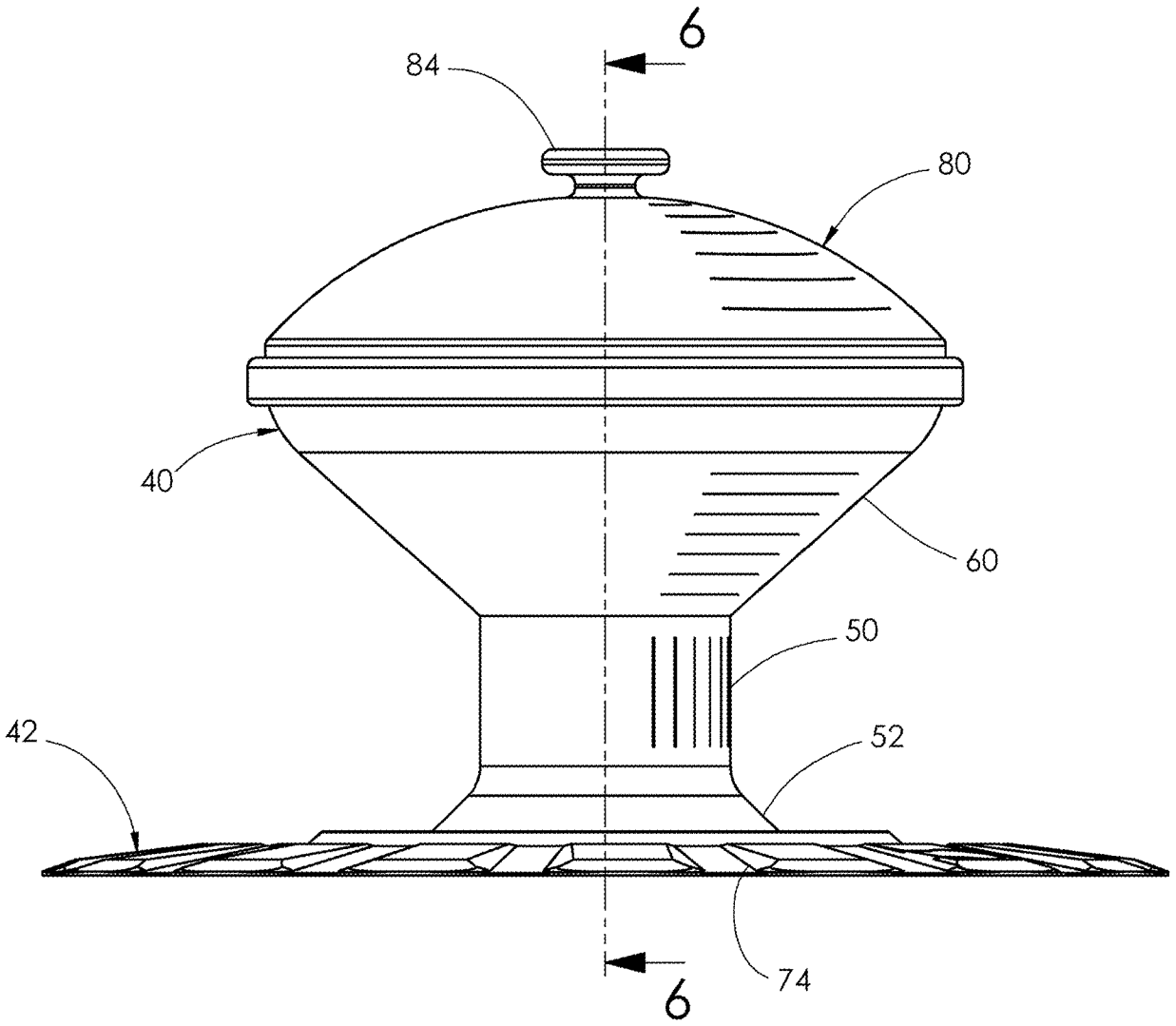
FIG. 5 is a front elevation of the game device of FIG. 4.

As shown in FIGS. 2 and 3, the game device 22 comprises a challis-shaped main component, generally designated by 40, and a selectively separable skirt, generally designated by 42. The main component 40 comprises a target platform 44 having a first scoring area 46 delineated by an annular ridge or ring 48 having a V-shaped cross section surrounding the first scoring area. A cylindrical stem or post 50 extends upward from the target platform 44 at a center of the first scoring area 46 as shown in FIG. 2. In addition, a sloped foot 52 and bead 54 are provided at a lower end of the post 50. The foot 52 and bead 54 act to prevent game pieces from coming to rest immediately adjacent to the post 50. These features also strengthen the connection between the post 50 and platform 44 of game devices 22 having unitary (i.e., inseparable) constructions. Alternatively, for variations having a separable platform 44 and post 50, the foot 52 provides a large base to increase stability. A cup or receptacle 60 is mounted on an upper end of the post 56 opposite the target platform 50. The cup 60 has a hollow interior 62 sized and shaped for receiving all of the game pieces (not shown). A lip 64 surrounding the cup 60 defines an opening 66 allowing access to the hollow interior 62. The opening 66 is sized to allow the game piece to enter and exit the hollow interior 62. The skirt 42 includes a second scoring area 70 is bounded by the annular ridge 48 surrounding the first scoring area 46 and a raised rim 72. As illustrated in FIG. 3, the raised rim 72 includes a plurality of spaced protrusions or ramps, generally designated by 74, that affect the bounce and rumble of game pieces and guide the game pieces onto the second scoring area 70. The illustrated protrusions 74 have a plurality of planar faces or facets 76 that are obliquely oriented relative to the target platform 44, particularly the scoring areas 46, 70. Although the illustrated skirt 42 includes sixteen, identically shaped, evenly spaced protrusions, those skilled in game design will appreciate the protrusions 74 may have different shapes and spacings. Further, it is envisioned the skirt 42 may have fewer or more protrusions 74.

Figures 6, 7:
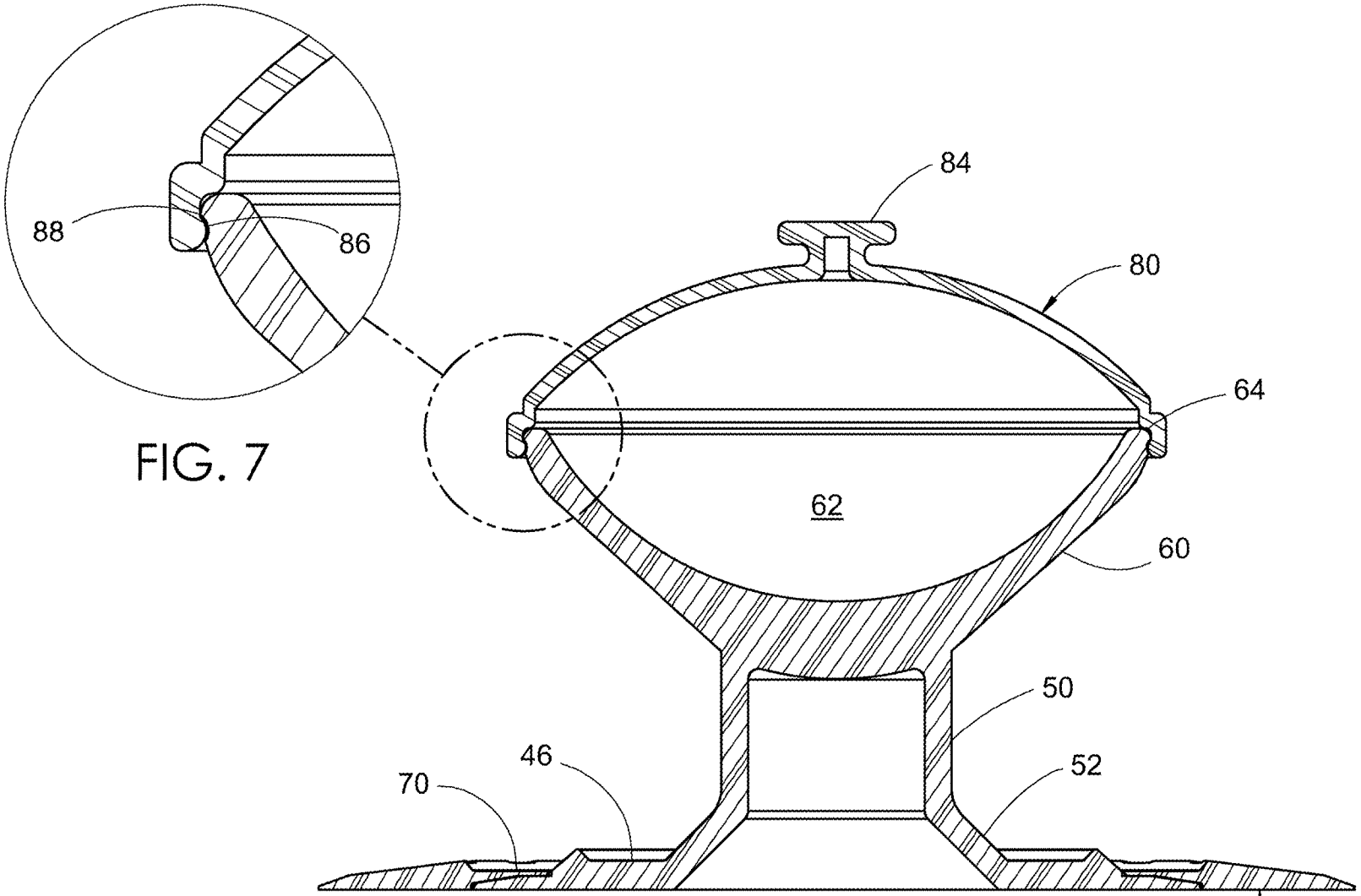
FIG. 6 is a is a cross section of the game device of FIG. 4 taken along line 6-6 of FIG. 5.
FIG. 7 is a detail of the game device of FIG. 4 as indicated in FIG. 6.
Figure 8:
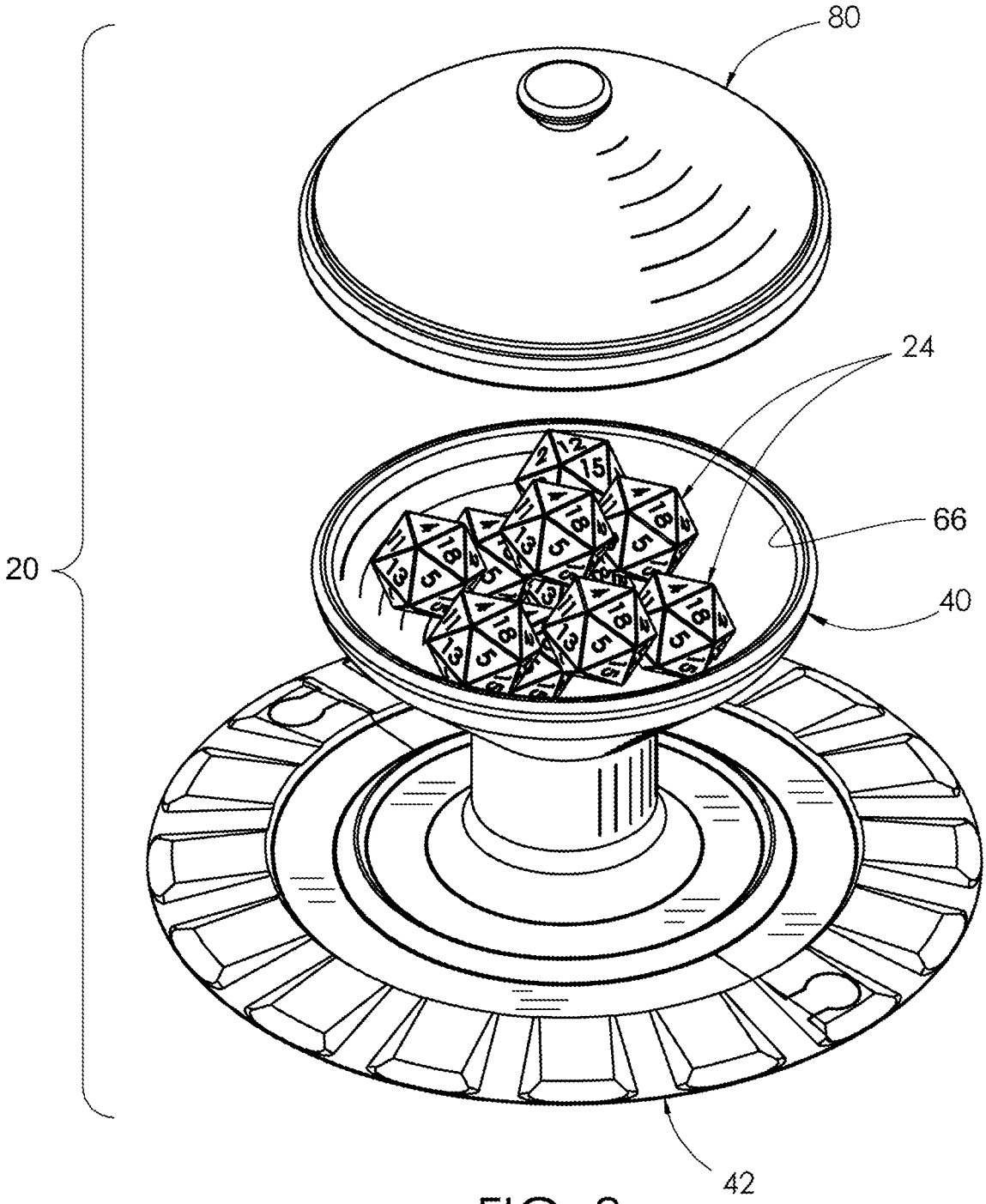
FIG. 8 is a partially separated perspective of the game device of FIG. 4 shown in combination with a plurality of game pieces.

As shown in FIGS. 4-9, the game device 22 may optionally include a lid, generally designated by 80. A first exemplary lid 80 shown in FIGS. 4-9 includes a dome 82 for covering the opening 66 of the cup 60 and a knob or handle 84 for grasping the lid. In some examples such as shown in FIGS. 6 & 7, the lid 80 includes a hooked edge 86 for selectively engaging a hooked edge 88 on the lip 64 of the cup 60 to fasten the lid to the cup. As will be appreciated, the materials chosen to construct the cup 60 and lid 80 and the dimensions of the engageable hooked edges 86, 88 allow one or both the cup and lid to deflect as the hooked edges engage and disengage when connecting and disconnecting the lid and cup. One of the advantages of forming the lid 80 and cup 60 so the lid is releasably fastenable to the cup is that game pieces 24 may be stored in the interior 62 of the cup when the game system 20 is not being used.

Figure 9:
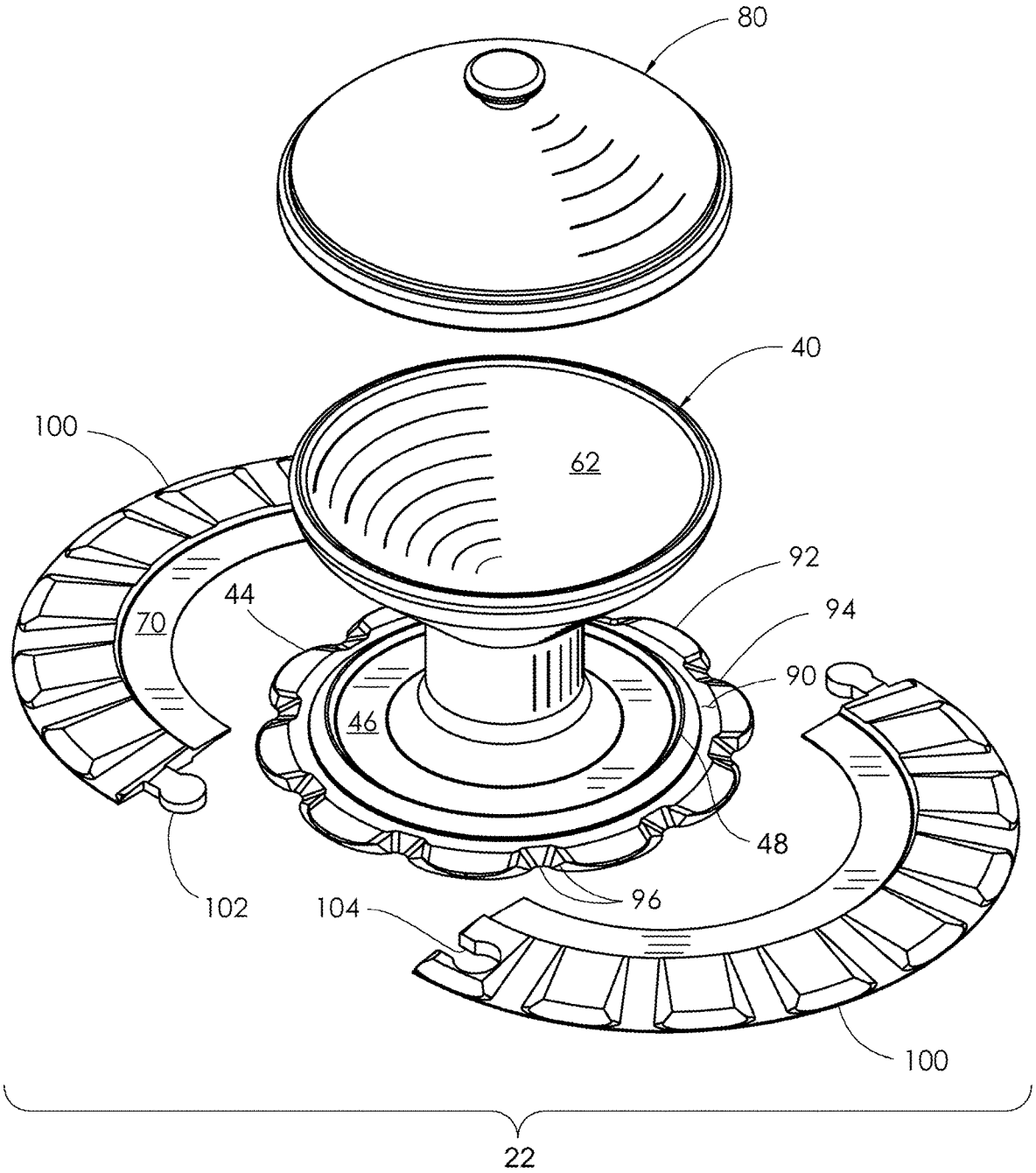
FIG. 9 is a separated perspective of the game device of FIG. 4.

As illustrated in FIG. 9, the target platform 44 of the challis-shaped main component 40 has a flat land 90 surrounding the ridge 48. A plurality of equally spaced tongues 92 extend radially outward beyond the land 90 and support an inner margin of the skirt 42 when used. Each tongue 92 is separated from the neighboring tongues by a notch 94 having steep walls 96. As will be appreciated, when the game device 22 is used without the skirt 42, the tongues 92 and notches 94 affect the bounce and tumble of the game pieces and guide playing pieces upward onto the land 90 or block the playing pieces from reaching the land. Although the illustrated target platform 44 has ten, identically shaped, evenly spaced tongues 92, those skilled in the art will appreciate the tongues may have differing shapes and spacings. Further, it is envisioned the target platform 44 may have fewer or more tongues 92. As will be appreciated, playing without the skirt 42 eliminates a scoring area, potentially increasing game difficulty. FIG. 9 shows that the illustrated skirt 42 is separable into sections 100. Each of the sections 100 of the illustrated examples are identical, having a keyed tab 102 on one end and a slot 104 shaped to receive the tab so the sections lock together. It is envisioned that other types of connectors may be used instead of the keyed tabs 102 and slots 104 or that the tabs and slots may have other interlocking shapes. As shown in FIG. 6, each of the sections 100 is tapered below the second scoring area 70 to accommodate the land 90 and tongues 92 when the skirt 42 is connected to the main component 40. Although the illustrated skirt 42 separates into two sections, it is envisioned the skirt may be made to be separated into more sections to reduce space required to store the game device 22 when disassembled. Additionally, it is envisioned that the skirt may be made as a single piece and sized to be lowered onto the target platform 44 from above. Further, it is envisioned that the skirt 42 may be formed integrally with the target platform 44 of the challis-shaped main component 40 in some examples and that the device may have additional skirts surrounding the skirt to increase scoring opportunities.

Figure 10:
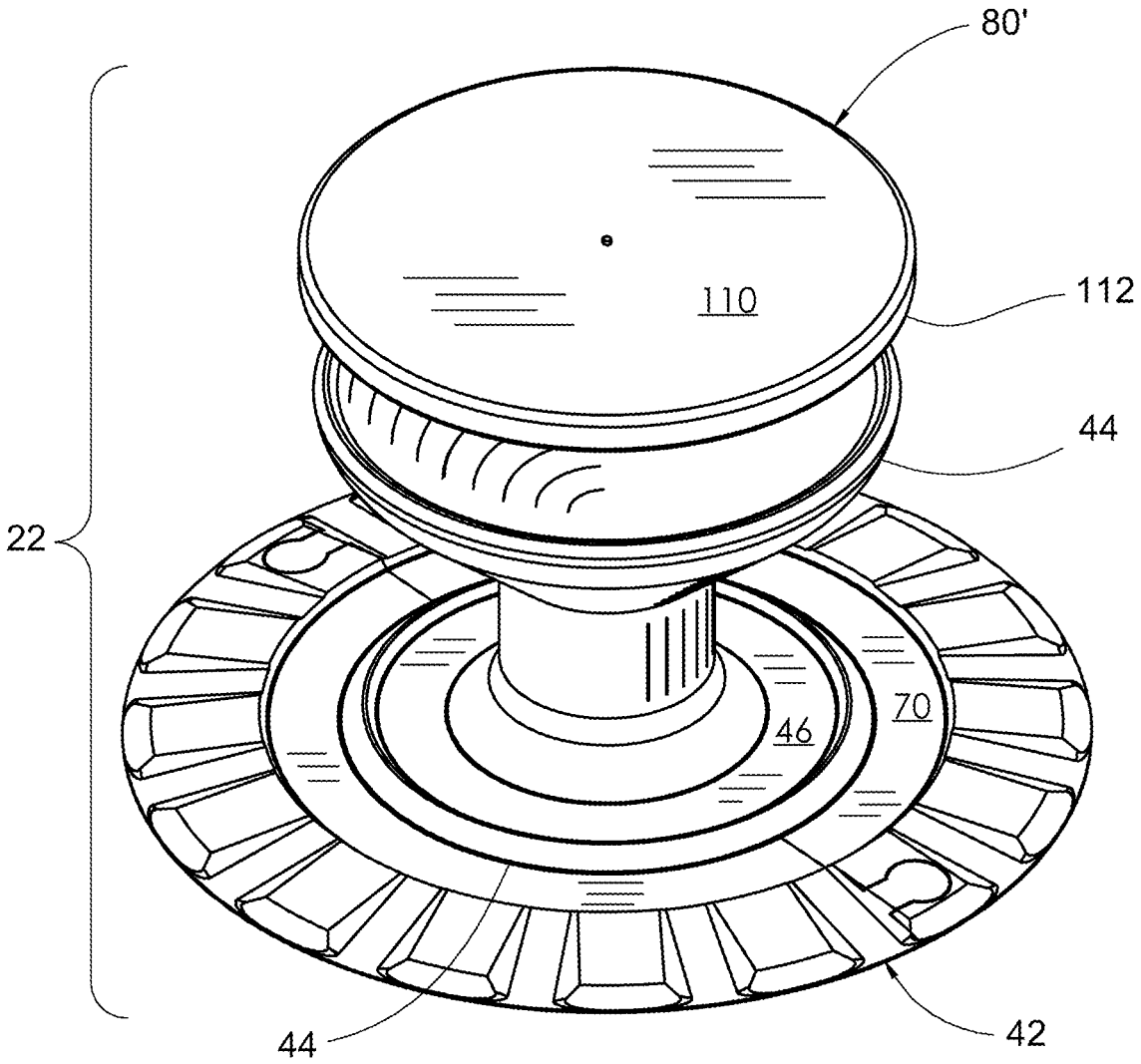
FIG. 10 is a partially separated perspective of the game device of FIG. 2 having a second exemplary lid.

FIG. 10 illustrates a game device 22 similar to that described above but having a second exemplary lid 80'. The second exemplary lid 80' has a flat cover 110 formed without a knob. A rim 112 extends downward from an outer edge of the flat cover 110. The rim 110 includes a hooked edge 86' for selectively engaging the hooked edge 88 on the lip 64 of the cup 60 to fasten the lid 80' to the cup. To remove the second exemplary lid 80', a user grasps the lid by the rim 110 and pulls the lid away from the cup 60. As the game device 22 illustrated in FIG. 10 is identical in all other respects to the game device illustrated in FIGS. 4-9, it will not be described in further detail.

Figure 11:
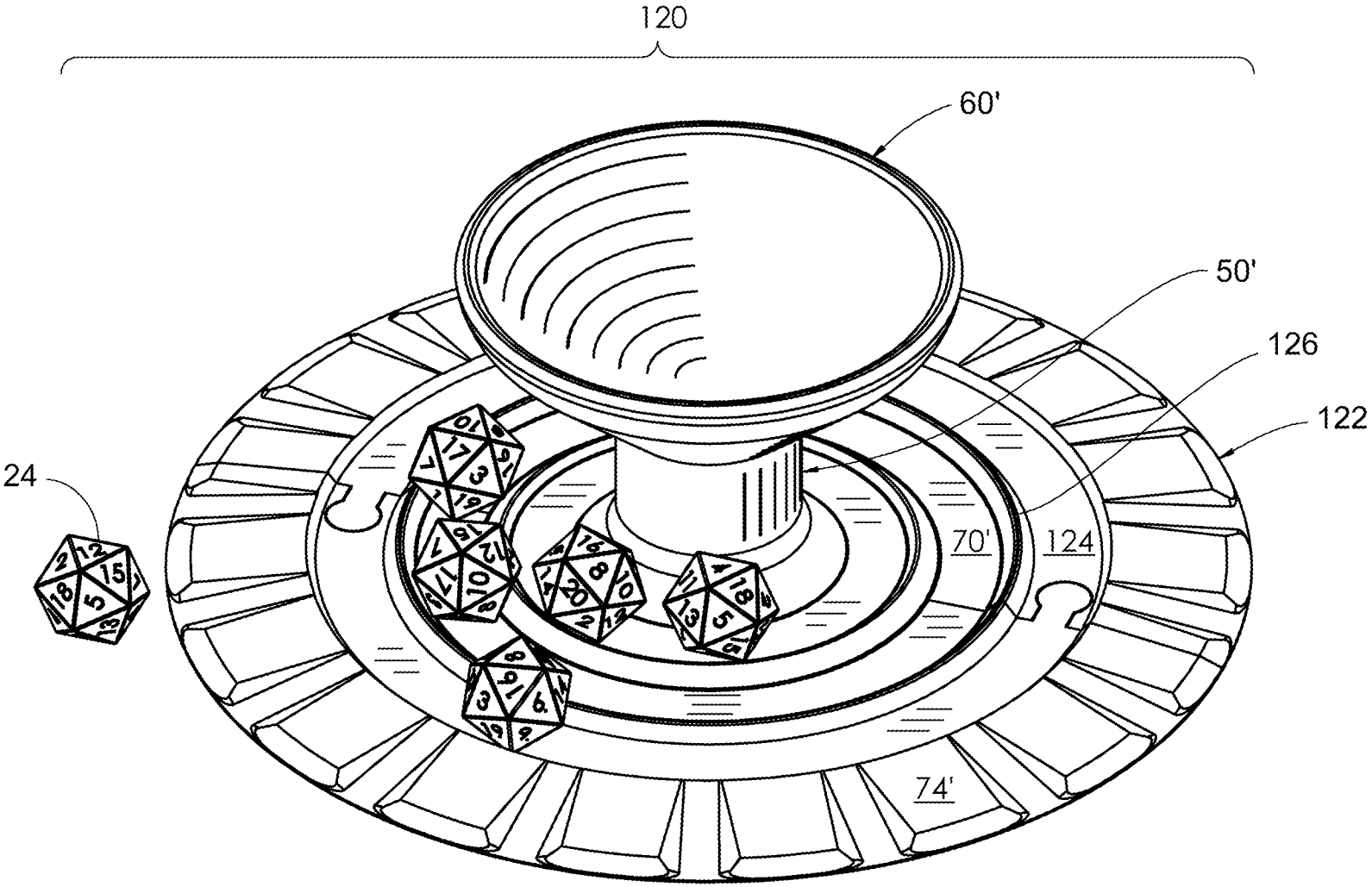
FIG. 11 is a perspective of a second example of a game system of the present disclosure.

FIG. 11 illustrates a second example of a game system 120 which is similar to the first example except it includes a larger skirt, generally designated by 122, having a third scoring area 124 located between the second scoring area 70' and the protrusions 74'. The third scoring area 124 is separated from the second scoring area 70' by an annular ridge 126 having a configuration similar to the ridge 48 on the main component 40. The larger skirt 122 accommodates more protrusions 74' than the skirt 42 of the first example game system 20. Although the illustrated skirt 122 includes eighteen, identically shaped, evenly spaced protrusions, those skilled in the art will appreciate the protrusions 74' may have differing shapes and spacings. In addition, it is envisioned the skirt 122 may have fewer or more protrusions 74'. As the game system 122 illustrated in FIG. 11 is identical in all other respects to the game system 20 illustrated in FIGS. 1-3, it will not be described in further detail. The larger skirt 122 is advantageous when the game system 120 is used by larger groups of players.

Figure 12:
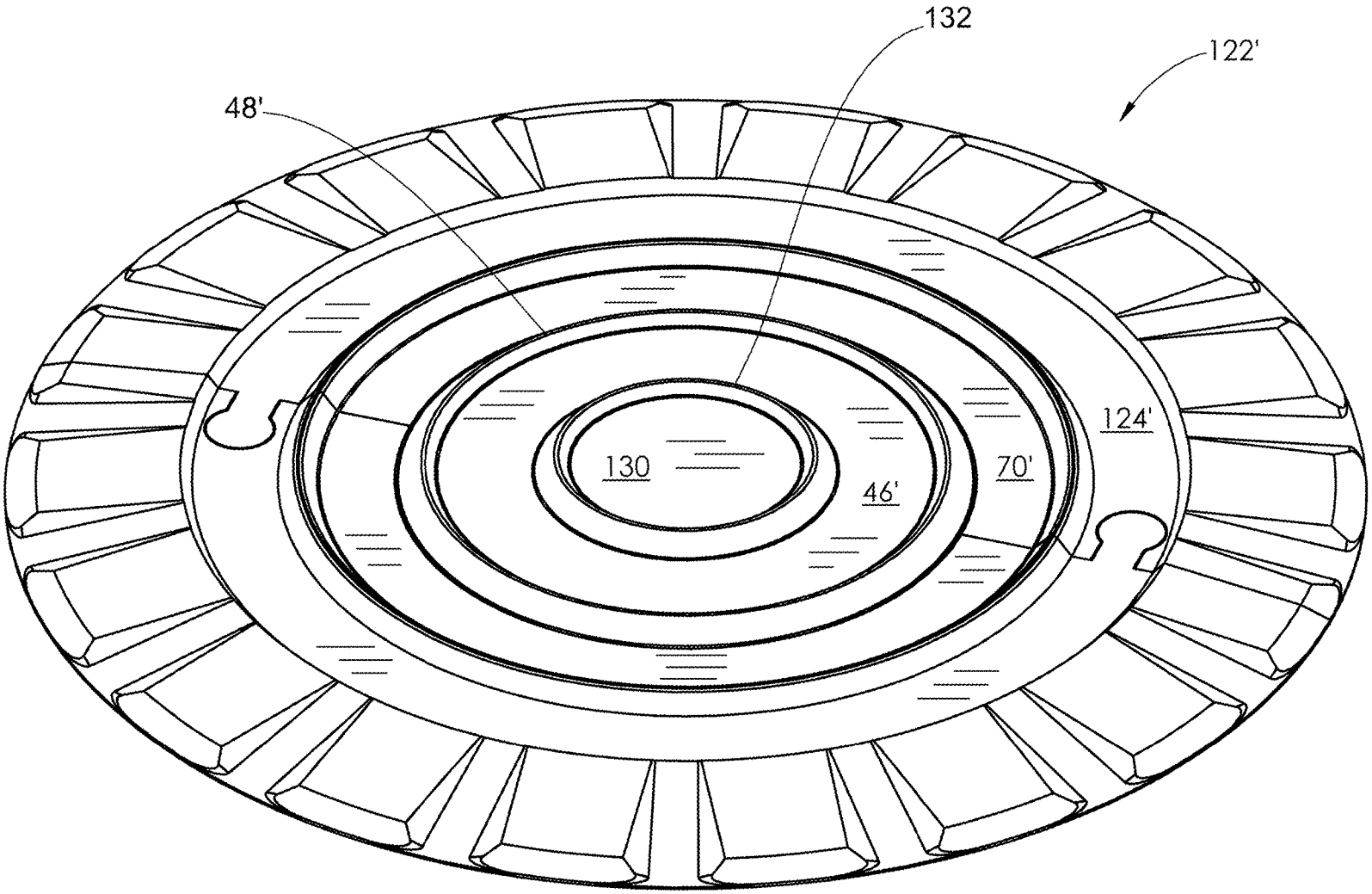
FIG. 12 is a perspective of the game device of the game system of the second example shown in an optional configuration.

As shown in FIG. 12, it is envisioned that the post 50' and cup 60' of the second example game system 120 may be selectively separable from the target platform 44' to change the configuration of the game device 22'. In the example illustrated in FIG. 12, removing the post 50' and cup 60' exposes a circular central scoring area 130 separated from first scoring area 46' by an annular ridge or ring 132. The illustrated circular central scoring area 130 is generally elevated relative to the first scoring area 46'. Further, the ridge 132 has a V-shaped cross section. As will be appreciated, the height of the ridges, including ridge 132 may be altered from the illustrated examples to change the difficulty of scoring.

Although the game device may be sized differently (e.g., for outdoor play) the game device 22 of the illustrated example is sized for tabletop play. It is further envisioned that the game device may be formed as a unitary device using conventional manufacturing methods such as 3D printing or injection molding. Although the illustrated game devices are made from conventional plastics, those skilled in the art will appreciate that the devices may be made from other suitable materials. In addition, it is envisioned that the main device 24 may be formed as separate pieces. The separate pieces may be joined using conventional techniques, such as adhesive bonding, or joined by connectors (e.g., bayonet connectors and detent connectors) either permanently or for selective separation.

As will be appreciated, the game systems described above are reconfigurable to allow games of varying complexities and configurations. Following are a sampling of potential games played using the game systems described above.

Illustrative Methods of Use—

Example 1—"Rock'um"

Rock'um is played using a game device having a central post surrounded by at least one scoring area and multiple sets of dice as game pieces. The innermost annular scoring area is called, "the ring." Each player starts with an equal number of dice (e.g., three to five dice) called "rocks." Each set of rocks has a unique color so players can identify their rocks. The number of dice in each set is selected before play begins. In one variation played by four players, each set of playing pieces consists of five dice. In a variation played by more than four players, each set consists of three dice. In some examples, each die is twenty-sided polyhedron having faces numbered 1 through 20.

To determine which player goes first, each player throws one rock. The player with the highest number showing on their rock starts. During their turn, a player may throw from any position around the game device, or the players may decide before play begins that they must remain in their places. When throwing a rock, the rock must contact the tabletop or game device outside the scoring areas before touching the post or scoring areas. During a turn, the player may throw any number of rocks before passing to the next player but must throw at least one rock when they have rocks remaining. Each player must wait for the prior player to pass or run out of rocks. Players may intentionally throw their rocks to knock any other rock into a higher or lower scoring position. Players take turns clockwise throwing rocks until every player has thrown all of their rocks. Optionally, a player may designate someone else to throw their rock.

After all players have thrown their rocks, scores are totaled for the round. Rocks resting in the ring are awarded three points, and rocks resting in other scoring areas are awarded one point. The player having the highest score wins the round. If players are tied for highest score, the tied players play a "duel" to determine the winner of the round. The player who reached the highest score first starts the duel. If no rocks are resting in the ring or other scoring area, the round is null and the next player clockwise from the previous starter begins the next round. After the first round, the player who won the prior round starts the next round.

Optional play: Before a round, the players may designate rocks showing specific numbers as wild. For example, if a rock shows a 1 or an 11, the rock is scored as zero, and if a rock shows a 10, the rock is awarded twenty points. If a player throws two pieces that show the same number, their score is doubled.

Optional scoring: The player throwing the rock showing the highest value resting in the highest value scoring area wins the round or is awarded additional points. Optionally, the player throwing the rock showing the lowest value resting in the lowest value area, including non-scoring areas, loses the round or is awarded fewer points.

Optional game device configuration: The skirt may be removed from the game device, leaving the ring as the only scoring area.

Example 2—"Rock'um for Points"

This game is similar to Rock'um except the players play multiple rounds until a player accumulates a predetermined number of points (e.g., 30, 50, 100, 300, or 500 points). The first player to reach the predetermined number of points wins. Two or more players may play this game.

Example 3—"Missouri Rock'um"

This game is similar to Rock'um but includes antes and/or wagers. The ante and maximum allowed wagers are decided before the start of each round. Players must place their ante in the cup to play the round. Optionally when wagering, each time a player ends their turn having a higher score than the previous high score for that round, they may make a wager that no other players will beat their higher score. Wagers are added to the cup. Players must match the wager to continue playing the round. Players who do not match the wager sit out for the rest of the round. The player having the highest score at the end of the round wins the accumulated antes and wagers in the cup. Two or more players may play this game.

Example 4—"Rock'um Away"

This game is similar to Rock'um but the player having the highest score at the end of each round puts one die in the cup. The first player having all of their dice in the cup wins. Two or more players may play this game.

Example 5—"Ultimate Rock'um Away"

This game is similar to Rock'um except the player having the highest score at the end of the round puts one die in the cup and the player having the lowest score at the end of the round takes one of their dice out of the cup if there is one of their dice in the cup. If players are tied for lowest score at the end of the round, each of the tied players removes one of their dice out of the cup if they have a die in the cup. The first player having all of their dice in the cup wins. It is envisioned that this game be played with three or more players.

Example 6—"Rock'um Holdout"

The game is played similarly to Rock'um, but each player starts the game with an equal number of tokens (e.g., four tokens). Each player antes one token in the cup at the beginning of each round. When a player ends a round with the lowest score, they must put one additional token in the cup to play the next round. Optionally, any player who does not win the round must put one additional token in the cup to play the next round. The last player holding a token wins. Optionally where gambling is permitted, coins are used instead of tokens. The winner collects the coins accumulated in the cup. It is envisioned that this game be played with two or more players.

Example 7—"Rock'um Hold'um"

The game is played like Rock'um Holdout except when a player ends a round with the highest score, they put a die in the cup. In addition, when a player ends a round with the lowest score, they take one of their dice from the cup if any of their dice are in the cup. The player ending the round with the lowest score must also put one token in the cup to play the next round. Optionally, any player who does not win the round must take one of their dice from the cup if any of their dice are in the cup and put one token in the cup to play the next round. The first player to have all of their dice in the cup and still hold a token wins. It is envisioned that this game be played with three or more players.

Example 8—"Rocks"

Players take turns throwing all of their dice attempting to obtain the highest score After each turn, the previously thrown dice are collected before the next player throws. Once all of the other players have had a turn trying to beat the high score and failed, the round is over and the player with the high score wins. If a player beats the high score, play continues until all of the other players have had a turn trying to beat the new high score and failed. If players tie the high score, the tied players play a "duel" to determine the winner of the tied round. One dueling round is played during a duel unless dueling players have tied high score again. The first dueling player to obtain the high score starts the dueling round. Two or more players may play this game.

Example 9—"Missouri Rocks"

This game is like Rocks except with antes and wagers. The ante and maximum allowed wagers are decided before the start of each round. Players must place their ante in the cup to play the round. Each time a player ends their turn having a new high score during a round, they may make a wager that no other players will beat their new high score. Wagers are added to the cup. Players must match the wager to continue playing the round. However, a player who does not match the wager may have one more turn to try to beat the high score. The non-wagering player may not take another turn during the round. The player having the highest score at the end of the round wins the accumulated antes and wagers in the cup. Two or more players may play this game.

Example 10—"Rock'um Horse"

It is envisioned that this game be played by two teams. Each team consists of an equal number of players. Each team uses an equal number of dice (e.g., three dice) called, "rocks". To determine which team starts, each team throws one rock. The team having the higher number showing on their rock starts. If there is a tie, the teams throw one rock again until one team has a higher number showing on their rock than the other team. After the first round, the team winning the previous round starts.

Each round is played by one player from each team using the rules of the basic game except scoring, which is similar to horseshoes. A rock resting in the ring at the end of the round is cancelled if the other team has a rock resting in the ring. Cancelled pairs are removed, and each rock remaining in the ring after the cancelled pairs are removed is called a "ringer" and is awarded three points. The team scoring ringers is awarded one point for each of their rocks resting in the other scoring areas. If neither team has a ringer, rocks resting in the other scoring areas are cancelled and removed in opposing pairs. Each rock remaining in the other scoring areas after the cancelled pairs are removed is awarded one point. Each team rotates players at the end of each round. Team points are tallied until one team reaches a predetermined total (e.g., 11 or 21 points).

When introducing elements in this description and the claims, the articles "a", "an", "the", and "said" are intended to indicate one or more of the elements. The terms "comprising", "including", and "having" are intended to be inclusive and indicate there may be additional elements other than the listed elements.

As those skilled in the art could make various changes to the above constructions, products, and methods without departing from the intended scope of the description, all matter in the above description and accompanying drawings should be interpreted as illustrative and not in a limiting sense. The patentable scope of the disclosure is defined by the claims, and can include other constructions and methods that would occur to those skilled in the art. Such other constructions are intended to be within the scope of the claims if the structural elements of the constructions do not differ from the literal language of the claims, or if the constructions include equivalent structural elements having insubstantial differences from the literal languages of the claims.

To the extent that the specification, including the claims and accompanying drawings, discloses any additional subject matter that is not within the scope of the claims below, the disclosures are not dedicated to the public and the right to file one or more applications to claims such additional disclosures is reserved.

The invention claimed is:

1. A game device comprising:

a target platform having a delineated scoring area;

a post extending upward from the target platform; and a cup mounted on the post opposite the target platform, said cup having a hollow interior sized and shaped for receiving a plurality of game pieces and an opening configured to pass each game piece of said plurality of game pieces therethrough when positioning said game piece in the hollow interior and removing said game piece from the hollow interior;

wherein said cup is devoid of openings below the hollow interior so that each game piece of said plurality of game pieces remains in the hollow interior when positioned in the hollow interior until removed from the hollow interior through said opening.

2. A game device as set forth in claim 1, further comprising a lid for selectively covering the opening of the cup to retain said plurality of game pieces received in the hollow interior.

3. A game device as set forth in claim 1, in combination with a plurality of game pieces, wherein each game piece of said plurality of game pieces comprises a regular-polyhedron-shaped element having a plurality of faces, each face of said plurality of faces having a demarcation thereon.

4. A game device as set forth in claim 3, wherein the demarcation on each face of said regular-polyhedron-shaped element is different from the demarcation on the other faces of said regular-polyhedron-shaped element.

5. A game device as set forth in claim 4, wherein the demarcation on each face of said regular-polyhedron-shaped element represents a value.

6. A game device as set forth in claim 3, wherein each game piece of said plurality of game pieces has a number of faces equal to those of all other game pieces of said plurality of game pieces.

7. A game device as set forth in claim 6, wherein each game piece of said plurality of game pieces is a regular icosahedron.

8. A game device as set forth in claim 1, further comprising a skirt surrounding the target platform.

9. A game device as set forth in claim 8, wherein the skirt is selectively removable from the target platform.

10. A game device as set forth in claim 9, wherein the skirt comprises a plurality of separable segments.

11. A game device as set forth in claim 10, wherein said plurality of separable segments consist of two identically shaped segments.

12. A game device as set forth in claim 8, wherein the skirt includes a plurality of protrusions surrounding the target platform.

13. A game device as set forth in claim 12, wherein each protrusion of said plurality of protrusions has a plurality of planar facets.

14. A game device as set forth in claim 13, wherein each planar facet of said plurality of planar facets it obliquely oriented with respect to the target platform.

15. A game device as set forth in claim 13, wherein each protrusion of said plurality of protrusions is identically shaped.

16. A game device comprising:

a target platform having a delineated scoring area;

a post extending upward from the target platform; and a cup mounted on the post opposite the target platform, said cup having a hollow interior sized and shaped for receiving a plurality of game pieces and an opening configured to pass each game piece of said plurality of game pieces therethrough when positioning said game piece in the hollow interior and removing said game piece from the hollow interior;

wherein:

said delineated scoring area is a first delineated circular scoring area; and the target platform has a plurality of delineated circular scoring areas including said first delineated circular scoring area.

17. A game device as set forth in claim 16, wherein:

said plurality of delineated circular scoring areas are concentrically arranged on the target platform; and the post extends upward from the target platform at a center of said plurality of delineated circular scoring areas.

18. A game device as set forth in claim 16, wherein each delineated circular scoring area of said plurality of delineated circular scoring areas is defined by a ridge projecting upward from the target platform.

19. A tabletop game device comprising:

a target platform having a plurality of concentrically arranged circular scoring areas, each of said plurality of scoring areas being separately defined by a corresponding ridge projecting upward from the target platform;

a cylindrical post extending upward from the target platform at a center of said plurality of concentrically arranged circular scoring areas;

a receptacle mounted on the post opposite the target platform for receiving a plurality of regular-polyhedron-shaped game pieces.

20. The game device as set forth in claim 19, further comprising a selectively removable skirt surrounding the target platform consisting of two identically shaped segments, each of said segments having a plurality of identically shaped protrusions, each protrusion of said plurality of protrusions has a plurality of facets; and each facet of said plurality of facets being obliquely oriented with respect to the target platform.

* * * * *